United States Patent [19]

Beldam

[11] 4,327,802

[45] May 4, 1982

[54] MULTIPLE FLUID HEAT EXCHANGER

[75] Inventor: Richard P. Beldam, Mississauga, Canada

[73] Assignee: Borg-Warner Corporation, Chicago, Ill.

[21] Appl. No.: 49,684

[22] Filed: Jun. 18, 1979

[51] Int. Cl.[3] ..... F28D 1/02; F28F 3/00

[52] U.S. Cl. ..... 165/153; 165/166

[58] Field of Search ..... 165/151, 152, 157, 166, 165/167, 153

[56] References Cited

U.S. PATENT DOCUMENTS

| | | | |
|---|---|---|---|
| 1,966,133 | 7/1934 | Pieper | 165/166 X |
| 2,264,820 | 12/1941 | Young . | |
| 2,511,084 | 6/1950 | Shaw | 165/157 X |
| 2,617,634 | 11/1952 | Jendrassik | 165/167 X |
| 2,937,856 | 5/1960 | Thomson . | |
| 3,207,216 | 9/1965 | Donaldson . | |
| 3,292,690 | 12/1966 | Donaldson . | |
| 3,743,011 | 7/1973 | Frost . | |
| 4,002,201 | 1/1977 | Donaldson . | |

*Primary Examiner*—Samuel Scott
*Assistant Examiner*—Theophil W. Streule, Jr.
*Attorney, Agent, or Firm*—James A. Geppert

[57] ABSTRACT

A multiple fluid heat exchanger having a unitary construction and formed of a stack of dished plates to form at least two fluid passages within the heat exchange elements formed by the plates and passages for a third fluid formed between at least some of the elements. The stack of plates are adapted to be simultaneously bonded together by a brazing or soldering operation, with the stack including at least one set of dished plates joined at their peripheries to form first and second fluid passages in a first set heat exchange elements, with the third fluid passages being formed in a second set of heat exchange elements. One set of heat exchange elements may have spaced fluid passages with corrugated heat exchange fins between the fluid passages to provide transverse passages for a cooling fluid, such as air. Additional arrangements of the sets of elements may be utilized for a fourth and/or fifth fluid.

38 Claims, 22 Drawing Figures

K
Q
P
90
63a
68a
71a
65a
67a
62a
69a
60a
59a
66a
54a
76a
98
53a
77a
96
101
93
94
92
95
99
98
93
101
91
99
97
92
98
93
101
76b
53b
77b
60a
55a
63a
65a
62a
75a
O
66a
72a
74a
N
73a
L
60a

MULTIPLE FLUID HEAT EXCHANGER

BACKGROUND OF THE INVENTION

A heat exchanger utilizing one fluid to cool one or more separate fluids finds common usage as a radiator for the coolant system of an internal combustion engine in automotive vehicles. A down-flow radiator of conventional design has a radiator core extending between upper and lower tanks or headers with the cooled fluid leaving the lower tank to a water pump which forces the fluid through the engine block. The hot fluid is returned to the upper tank of the radiator where it passes through a plurality of finned tubes forming the core with a second fluid (air) being drawn through the core and around the tubes and fins to cool the fluid forming the coolant.

Also requiring cooling in a vehicle is the transmission oil for the vehicle transmission or the engine oil. A water-to-oil heat exchanger of an elongated tubular design is conventionally positioned within the lower tank and has fittings extending to the exterior of the lower tank to connect to conduits extending from the transmission housing. One form of water-to-oil cooler utilizes a tubular conduit having an annular envelope for circulation of the oil with the cooled fluid circulating around and centrally through the envelope to provide a large heat transfer area.

A cross-flow radiator is formed with vertically oriented tanks and a tube and fin radiator core for horizontal flow or with a plurality of horizontally extending plates in a vertical stack and corrugated fins located in the spacing between the plates, such as shown in U.S. Pat. No. 3,207,216. However, in the arrangement shown in the above patent, the positioning of a water-to-oil cooler in the outlet header presents a problem in view of the space requirements and need for exterior fittings. All of the above down-flow and cross-flow radiator constructions involve a substantial number of parts and utilize two separate units to cool both the engine coolant and the transmission oil. The present invention provides a single heat exchanger construction to function to cool both the engine coolant and transmission and/or engine oil.

SUMMARY OF THE INVENTION

The present invention relates to a multiple fluid heat exchanger in a single unit wherein one fluid is utilized to cool at least one other separate fluid. More specifically, the heat exchanger is utilized as a cross-flow radiator for the cooling system of an internal combustion engine for automotive vehicles. The radiator provides separate flow passages for both the coolant used to cool the engine block and the transmission oil for the vehicle transmission while air is drawn through the spaces between the flow passages by a fan to cool the coolant fluid.

The present invention also relates to the provision of a heat exchanger constructed by bonding a series of suitably formed plates together in an aligned stack by soldering or brazing to form all necessary internal fluid passages and provide spacing between the passages for the flow of a cooling fluid or gas therebetween. Baffles may be used in the fluid passages and in the spacing therebetween to obtain optimum heat transfer characteristics.

The present invention further relates to the provision of a novel multiple fluid heat exchanger that is a single unit with appropriate fittings for both the engine coolant and the transmission oil of an automobile engine. The heat exchanger can be made in different cooling capacities by adjusting the number of water and/or oil plates in the stack.

The present invention also comprehends a novel multiple fluid heat exchanger having a totally enclosed liquid-to-liquid cooler of the stacked plate type used in conjunction with a plate-fin type radiator to produce a multi-fluid heat exchanger.

The present invention further comprehends a novel multiple fluid heat exchanger of the stacked plate type wherein all of the plates or elements are identical and a baffle plate is located centrally in the stack, with the plates formed pairs of parallel fluid passages. The baffle plate has a pair of openings aligned with one of the two pairs of openings in each plate so that three fluids may flow through the enclosed passages of the heat exchanger.

The present invention also comprehends a novel multiple fluid heat exchanger having three sets of plates or elements in stacked relation, with one set of elements having vertically spaced horizontal fluid passages with the spaces between the plates allowing for the passage of one fluid and the enclosed passages within the three sets of plates providing for the flow of three additional fluids therethrough.

The present invention also relates to the provision of a novel multiple fluid heat exchanger having several sets of plates wherein a water-to-air heat exchanger or vehicle radiator and an evaporator coil for an air conditioner unit are both included as well as one or more oil cooler units. This combination unit will provide maximum utility for a heat exchanger in an automotive vehicle.

Further objects are to provide a construction of maximum simplicity, efficiency, economy, and ease of assembly and operation, and such further objects, advantages and capabilities as will later more fully appear and are inherently possessed thereby.

DESCRIPTION OF THE PREFERRED EMBODIMENTS

Figure 1:
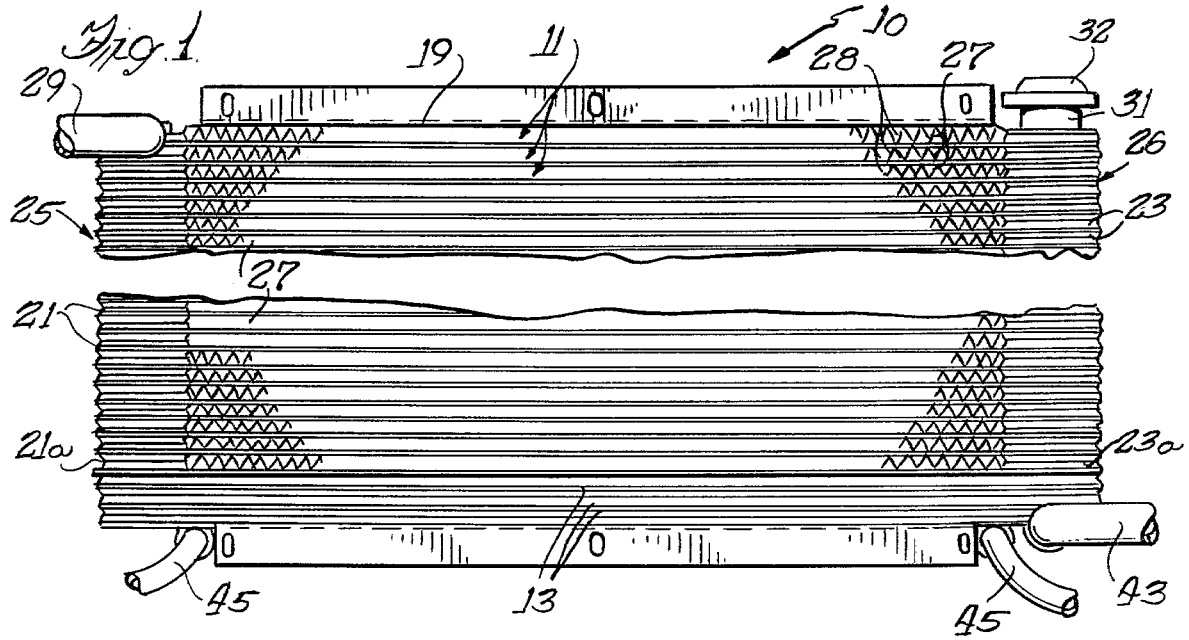
FIG. 1 is a rear elevational view of a cross-flow heat exchanger for three fluids.
Figure 2:
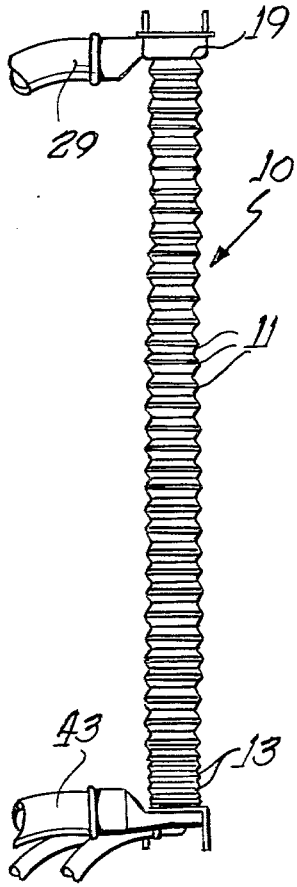
FIG. 2 is an end elevational view of the heat exchanger taken from the left-hand end of FIG. 1.

Referring more particularly to the disclosure in the drawings wherein are shown illustrative embodiments of the present invention, FIGS. 1 and 2 disclose a stacked plate cross-flow heat exchanger 10 for a three-fluid system such as a cross-flow radiator in the coolant system of an automotive internal combustion engine. In a conventional internal combustion engine, a coolant fluid, such as a 50—50 mixture of ethylene glycol and water, is pumped through the engine block and associated structure (not shown) to cool the engine; with the heated coolant then passing through a heat exchanger or radiator where the coolant flows through relatively narrow passages while air is drawn around the passages by an engine fan behind the heat exchanger. A water-to-oil cooler is usually inserted in the outlet tank of the radiator to receive hot oil from the transmission for the engine which passes through an annular envelope while the cooled coolant fluid circulates around and through the cooler to reduce the oil temperature prior to return to the transmission housing.

Figure 3:
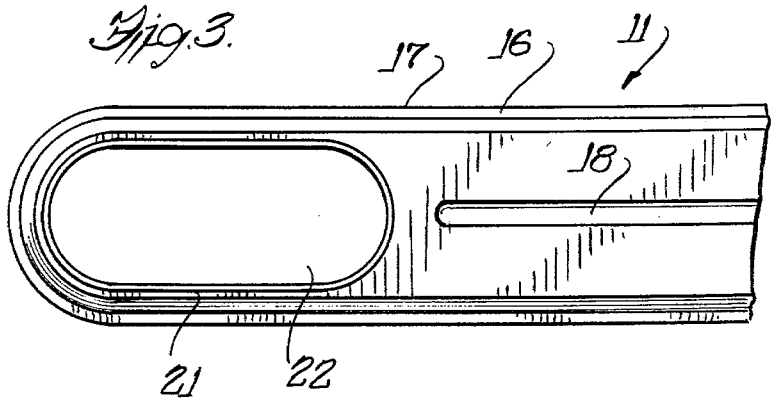
FIG. 3 is a partial top plan view of a heat exchanger plate utilized in the air-to-coolant portion of the radiator.
Figure 4:
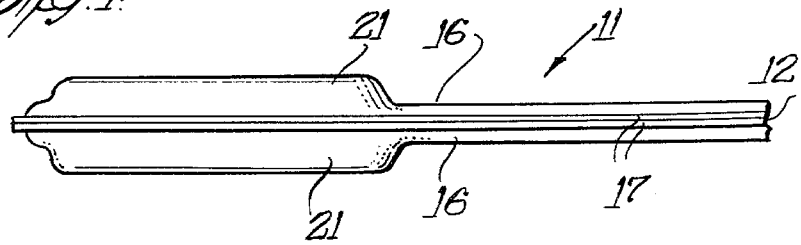
FIG. 4 is an edge elevational view of the plate of FIG. 3.

The heat exchanger 10 of the present invention is formed of an upper stack of enlongated hollow heat exchange elements 11 having passages 12 (FIG. 4) therethrough and a lower stack of elongated hollow heat exchanger elements 13 forming adjacent water and oil flow passages 14 and 15, respectively (FIGS. 5–9). Each element 11 is formed of a pair of dished facing plates 16,16 bonded together along their peripheral edges 17,17 (FIGS. 3 and 4). Each plate is formed with a central longitudinally extending depressed rib 18 in the surface thereof which defines a pair of parallel water passages 12,12 therein. An upper closure plate 19 (FIG. 1) has suitable openings and is joined to the upper surface of the uppermost element 11.

A raised flange or enlarged portion 21 defines an opening 22 forming an inlet, and a raised flange or enlarged portion 23 at the opposite end of the plate defines an opening 24 providing an outlet for the plate 16, the raised flanges extending from each side of the element 11 at each end thereof are in registration with complementary flanges of the aligned adjacent plates 16 and are suitably bonded thereto to provide an inlet chamber 25 and an outlet chamber 26 (FIG. 1). When the stack of elements 11 are bonded together by soldering or brazing, the central portions of the elements 11 are of a lesser vertical dimension than the vertical dimension between the flanges 21,21 or 23,23 so as to provide a space 27 between the passages 12 receiving a corrugated fin 28 (FIGS. 1 and 9) extending between the chambers 25 and 26 and of a width substantially equal to the width of the elements 11. The spaces 27 allow air flow between the passages 12 with the fins 28 acting to enhance the heat transfer from the fluid within the elements 11.

At the upper end of the inlet chamber 25, an inlet conduit 29 (FIGS. 1 and 2) communicates with an opening in plate 19 leading to the chamber, while a coolant supply and overflow fitting 31 having a pressure cap 32 communicates with the opposite opening in plate 19 above the chamber 26. The lower ends of both chambers 25 and 26 are open and communicate with the stack of second elements 13 as described below.

At the lower end of the stack of elements 11, a plate 16*a* (FIGS. 8 and 9) having the same configuration as the plates 16 is provided with raised flanges 21*a* and 23*a* bonded to the depending flanges 21 and 23 of the lowermost element 11. The periphery 17*a* of the plate 16*a* is also bonded to the periphery 34 of the uppermost plate 33 of the pairs of plates 33,33 for the oil cooling elements 13 forming a water passage 14a therebetween. Each of the plates 33 has a raised peripheral flange 34 (FIG. 5) bonded to the facing flange of the next adjacent element 13; the lowermost flange 34 being bonded to a plate 35 (FIGS. 8 and 9) at the lower end of the stack.

Figure 5:
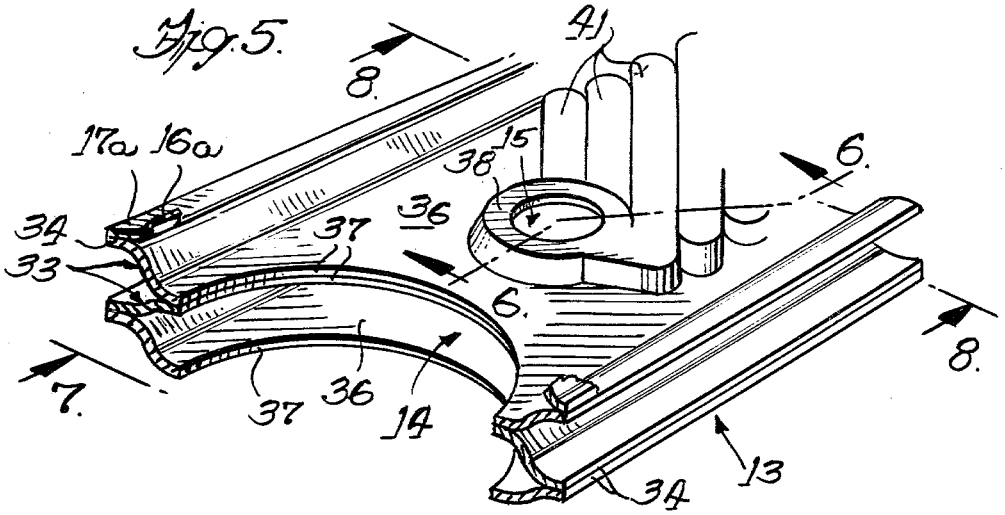
FIG. 5 is an enlarged partial perspective view partially in cross section of oil cooler plates showing the fluid flow of oil and coolant therethrough.
Figure 6:
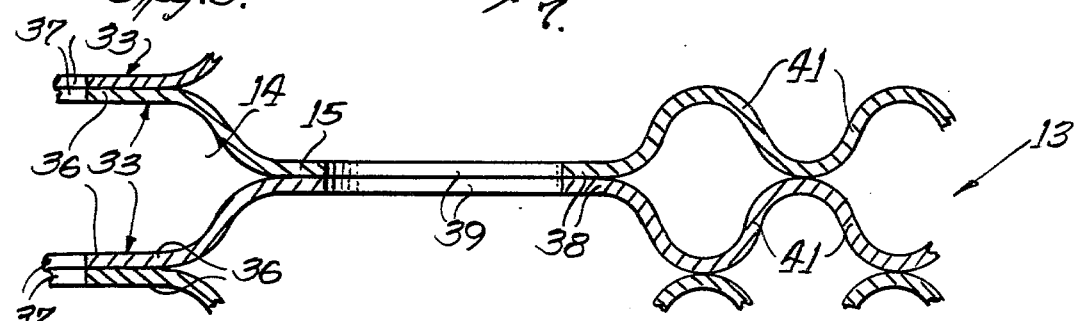
FIG. 6 is a vertical cross sectional view taken on the irregular line 6—6 of FIG. 5.
Figure 7:
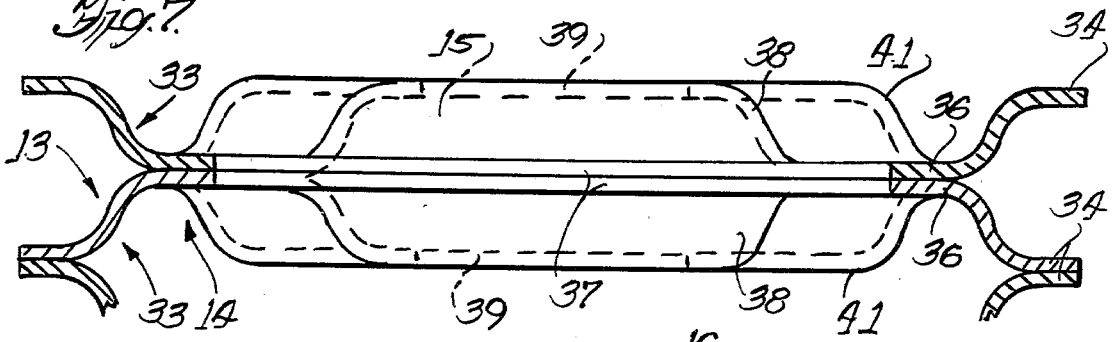
FIG. 7 is a vertical cross sectional view taken on the line 7—7 of FIG. 5.
Figure 8:
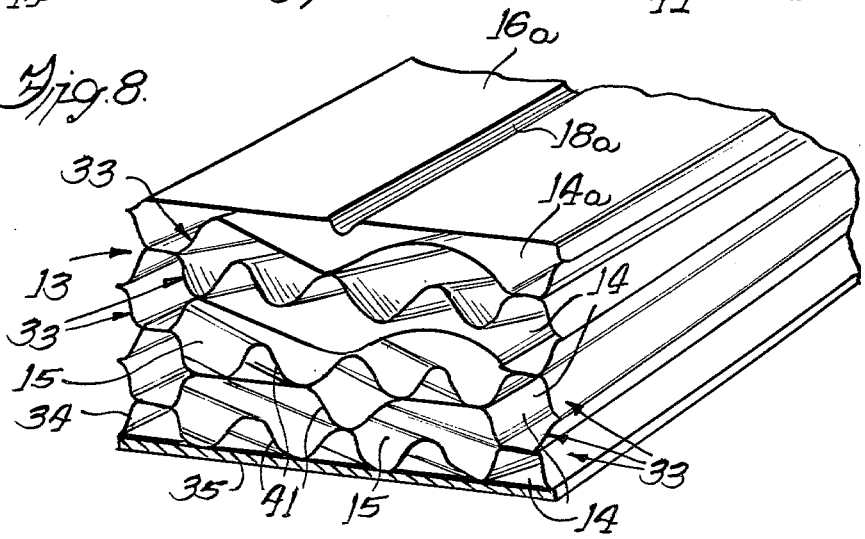
FIG. 8 is a perspective view partially in cross section of a portion of the heat exchanger taken on the line 8—8 of FIG. 5.

Each plate 33 has a flat surface 36 (FIG. 5) extending within the raised peripheral edge 34 and has enlarged openings 37,37 adjacent the ends to register with the openings 22 and 24 and provide an extension of the inlet and outlet chambers 25 and 26, and small raised flanges 38 defining openings 39 spaced inside of the openings 37 to act as the inlet and outlet for the transmission oil. Between the openings 39,39 in each plate is formed a series of ribs 41 extending outwardly in the same direction as the raised flanges 38 and flange or edge 34. The facing surfaces 36 abut and are bonded together, as seen in FIG. 5, with the raised flanges 38 and ribs 41 of a pair of bonded plates forming an oil passage 15 therebetween; the ribs 41 of one facing plate being angularly disposed to the ribs of the opposite plate.

Figure 9:
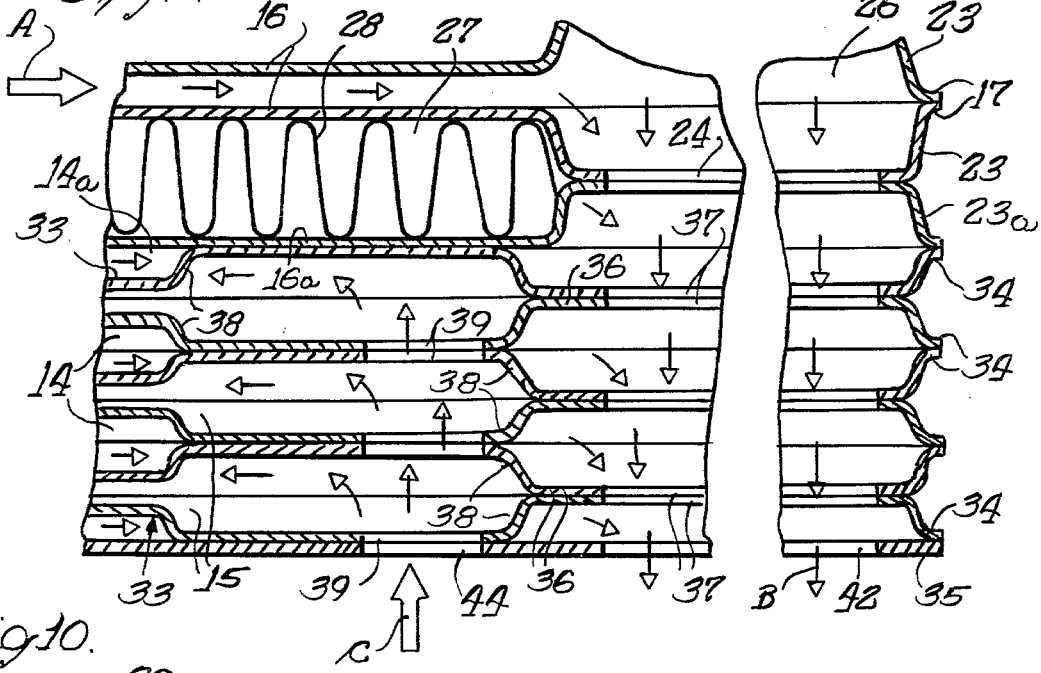
FIG. 9 is an enlarged partial vertical cross sectional view through one end of the heat exchanger showing the flow of the two fluids within the plates.

The peripheral flanges or edges 34 and raised flanges 38 of adjacent elements 13 register and engage to be bonded together, as shown in FIG. 9, so that the openings 39 are vertically aligned as are the openings 37 at each end. The spacing between the flat surfaces 36 as defined by the enclosing peripheries 34 provide the water passages 14 generally parallel to and surrounding the oil passages 15. At the lower end of the heat exchanger, the flat plate 35 engages the downwardly extending peripheral flange 34 of the lowermost plate 33 and closes the inlet chamber 25 aligned with the enlarged opening 37, and an opening 42 in the plate 35 is aligned with the enlarged opening 37 aligned with the outlet chamber 26 to communicate with an outlet conduit 43. The plate 35 also has spaced openings 44 coinciding with openings 39 to provide for the entrance and exit of transmission oil from conduit 45 into the elements 13. As seen in FIG. 9, the depending flanges 38 defining the openings 39 engage and are suitably bonded to the flat plate 35 with openings 39 aligned with openings 44. Also, the uppermost plate 33 is formed without openings 39 to close off the oil passages or, in the alternative, a baffle plate (not shown) could be used to close off the openings 39.

Figure 10:
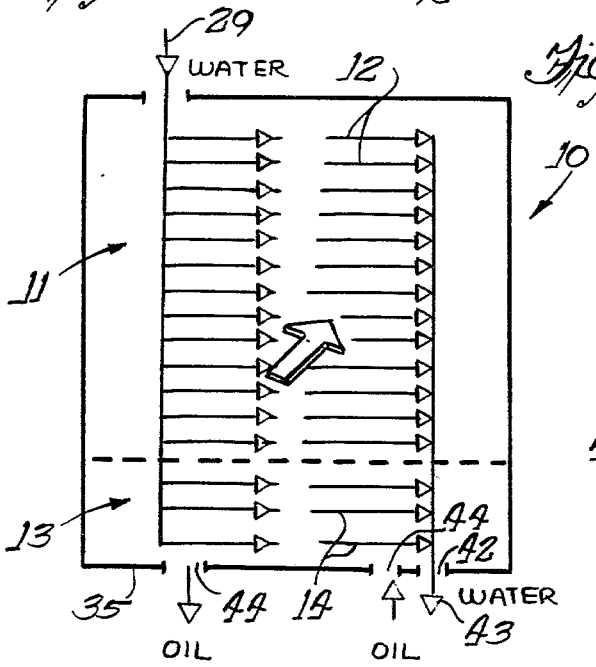
FIG. 10 is a schematic flow diagram of the fluids within the heat exchanger in a parallel arrangement.
Figure 11:
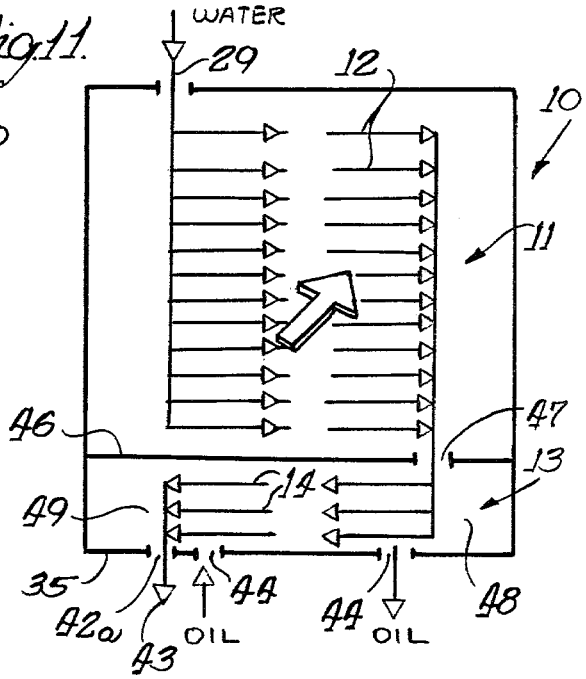
FIG. 11 is a schematic view similar to FIG. 10 but showing flow in a series arrangement.
Figure 9A:
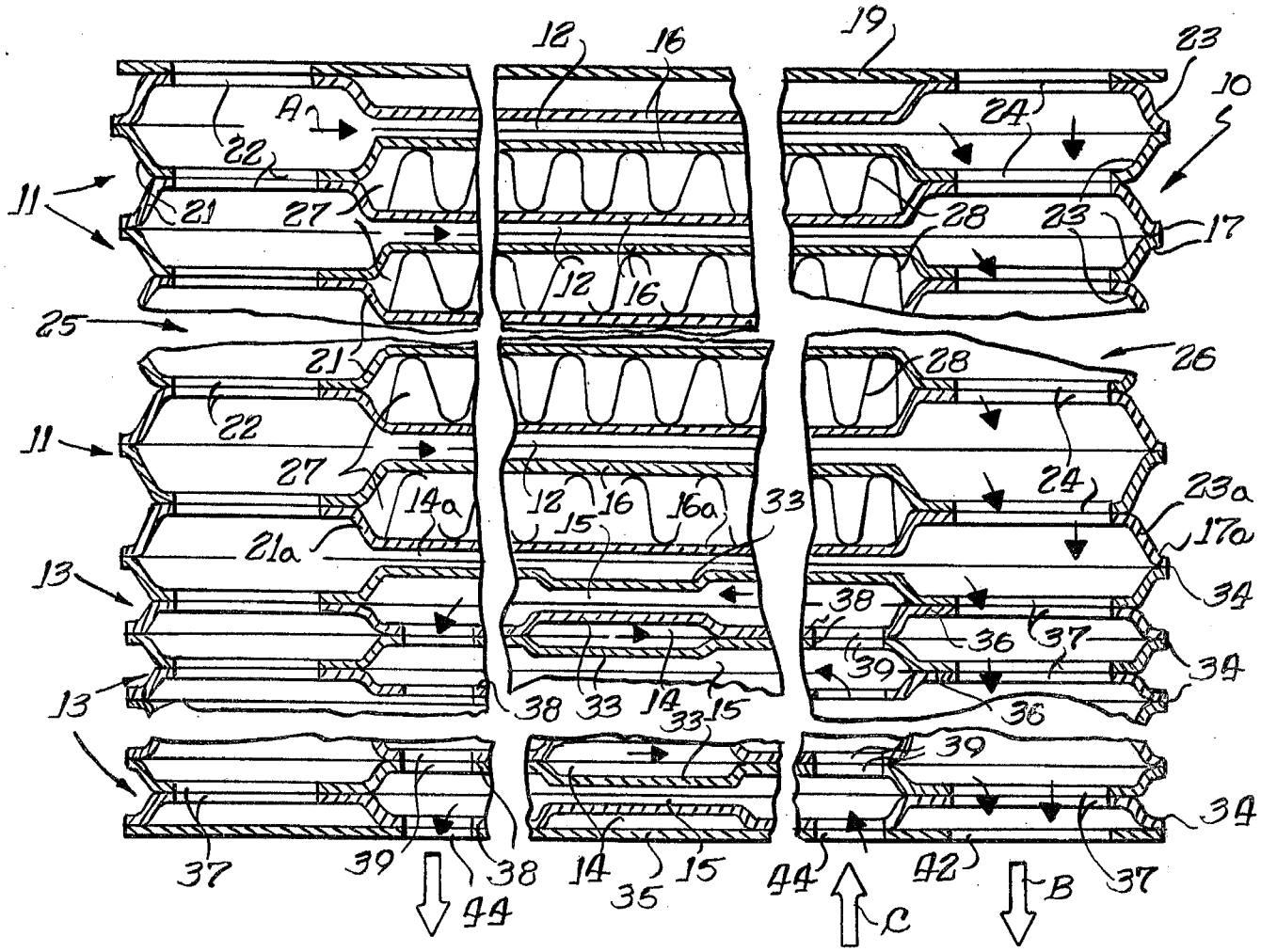
FIG. 9A is a complete vertical cross sectional view, with portions broken away, of the heat exchanger of FIGS. 1 and 2.

As seen in FIGS. 10 and 11, there are two possible flow patterns for the two fluids with the heat exchanger; the oil always flowing countercurrent to the direction of flow of the coolant. FIG. 10 discloses a parallel flow pattern which is the pattern for the structure shown in FIGS. 1 through 9. In this pattern, the coolant in its heated state enters the heat exchanger by the conduit 29 and passes into the inlet chamber 25 throughout both the elements 11 and the elements 13. The coolant then passes across the exchanger through both passages 12 and 14 (arrow A) to the outlet chamber 26 and downward to exit via the conduit 43 (arrow B). Simultaneously, the hot transmission oil enters the elements 13 from conduit 45 through the opening 44 in the plate 35 (arrow C) and the openings 39 in plates 33 adjacent the opening 42 and passes through the passages 15 to exit through the openings 39 and 44 adjacent the inlet chamber 25.

Also, air (the third fluid) is being drawn through the spaces or air passages 27 by the engine fan (not shown) to flow around the elements 11 and the corrugated fins 28 to cool the heated coolant. Thus, the coolant passing through the passages 12 is cooled by air flow through passages 27, and the coolant passing through passages 14 acts to cool the oil flowing through passages 15.

To increase the cooling ability of the heat exchanger for the transmission oil, simple structural changes alter the parallel flow in FIG. 10 to a series flow in FIG. 11. For series flow, a flat plate 46 is inserted in the exchanger between the elements 11 and the elements 13 so as to engage and be sealed to the lowermost plate **16*a* and the uppermost plate 33. The plate is imperforate to close off the openings 22 of the inlet chamber 25 and has an opening 47 vertically aligned with the openings 24 of the outlet chamber 26 in elements 11. Also, the plate 35 is reversed so that opening 42*a* is aligned with the openings 22 in the elements 11**.

As shown by the arrows in FIG. 11, the heated coolant enters the inlet chamber 25 formed in the elements 11 through the conduit 29. As the plate 46 blocks flow into the elements 13 on the inlet side, the coolant flows across only through the passages 12 to the chamber 26 while being cooled by air flowing through the passages 27 and around the fins 28. The cooled coolant then proceeds downward through the opening 47 into chamber 48 formed by the openings 37 in the elements 13 aligned with the chamber 26 and through the passages 14 in a direction opposite to the direction of flow in passages 12. Upon reaching the new chamber 49 axially aligned with but blocked from communication with chamber 25, the coolant, having cooled the transmission oil in passages 15, flows downward through opening **42*a* in plate 35 to the outlet conduit 43. The transmission oil enters the elements 13 through the opening 44 in plate 35 and openings 39 adjacent the chamber 49, flows through passages 15 in a direction countercurrent to the flow of coolant, and exists through openings 39 and 44 adjacent the chamber 48** to return to the transmission housing.

This heat exchanger is manufacturable as a single unit by stacking the requisite number of plates 16 and 33 with plate **16*a* therebetween and bonding them together in one operation. The unit can be made in different coolant capacities by adjusting the number of elements 11 and elements 13**.

FIGS. 12 through 16 disclose a second embodiment of heat exchanger 51 utilizing only liquid-to-liquid type elements 52 with a baffle 53 separating the elements into two sets 54 and 55. The elements 54 are identical to the elements 13 of FIG. 9, wherein each element consists of a pair of dished plates 56,56, each having a raised peripheral flange 57 joined to the facing flange of the plate of the next adjacent element 52. Each plate includes a generally flat surface 58 within the peripheral flange and having enlarged openings 59 and 60 at the opposite ends, small raised flanges 61 defining smaller openings 62 and 63 inside of the openings 59 and 60 and a series of raised ribs 64 extending outwardly in the same direction as the peripheral flange 57 and raised flanges 61 extend between the openings 62 and 63 to form a fluid passage 65 in each element. The flanges 61 are of the same height as the flanges 57 so that the aligned flanges 61 of adjacent elements 52 abut and are adapted to be joined together. The spacing between the surfaces 58 of adjacent elements forms a second fluid passage 66.

Figure 12:
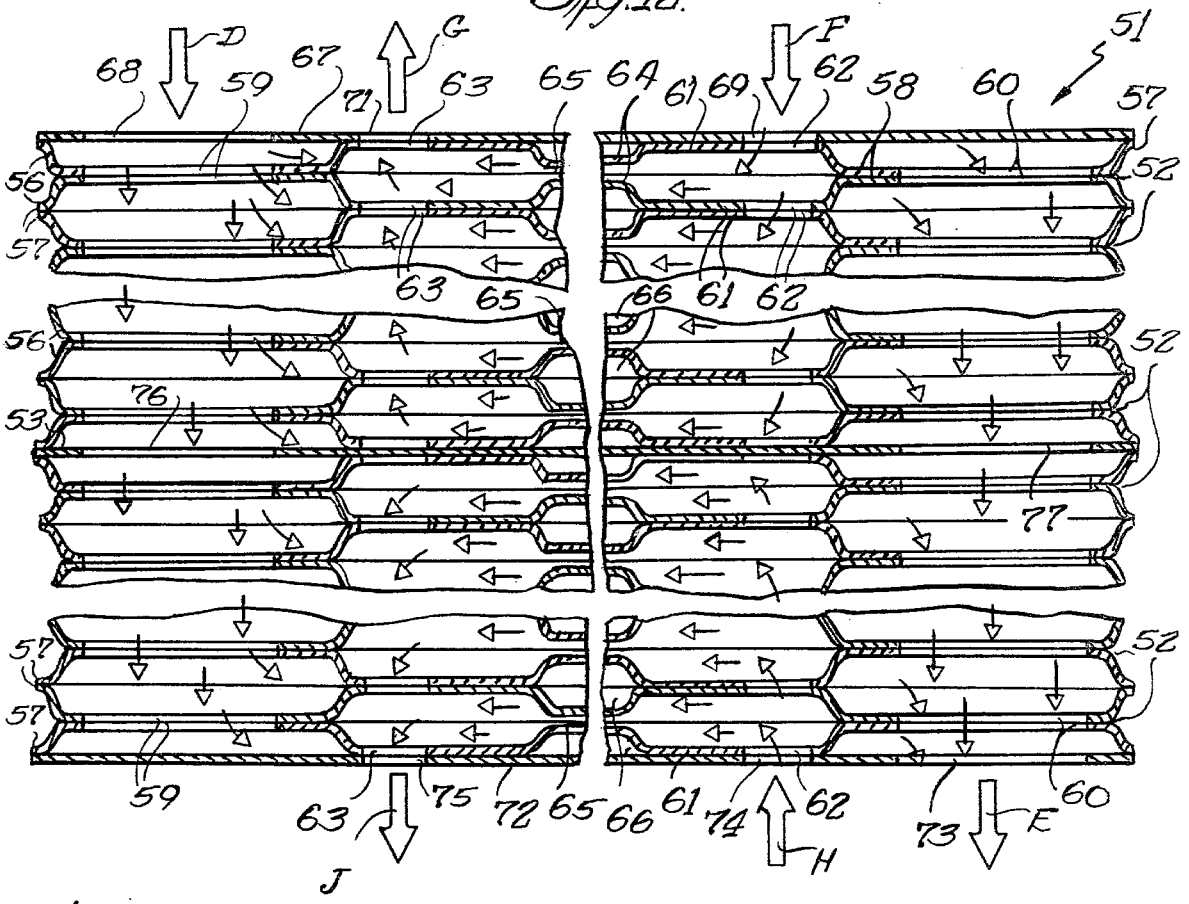
FIG. 12 is a vertical cross section with portions broken away of a second embodiment of heat exchanger having enclosed passages for three fluids.
Figure 13:
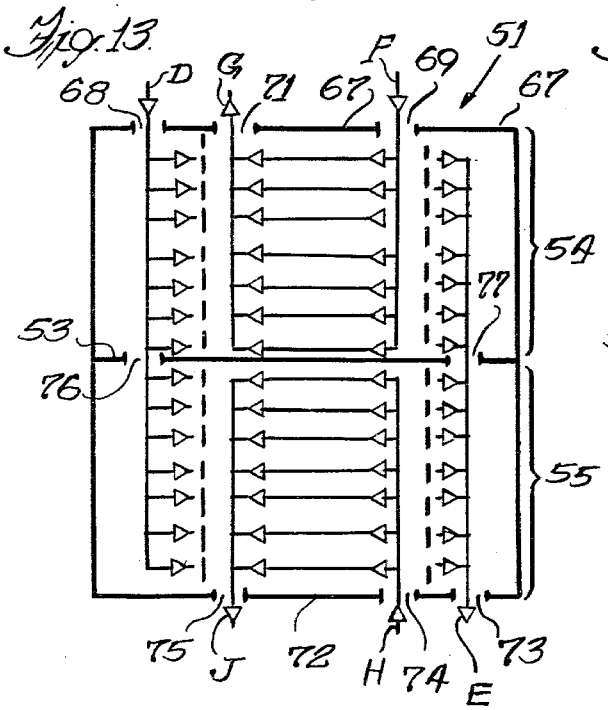
FIG. 13 is a schematic flow diagram of one flow pattern for the three fluids in the heat exchanger of FIG. 12.

An upper closure plate 67 is joined to the upwardly raised flange 57 of the uppermost element 52 and is provided with at least two openings therein. In the embodiment of FIGS. 12 and 13, the plate 67 is provided with a large opening 68 axially aligned with the openings 59 of the elements and small openings 69 and 71 aligned with the openings 62 and 63, respectively. A lower closure plate 72 is joined to the lower flange 57 of the lowermost element 52 and also is provided with at least two openings therein. In the embodiment of FIGS. 12 and 13, the lower plate 72 has a large opening 73 aligned with openings 60 of the elements 52 and smaller openings 74 and 75 aligned with openings 62 and 63, respectively. Also, the baffle 53 is provided with a pair of large openings 76 and 77 aligned with the openings 59 and 60, respectively, of elements 52.

As shown by the arrows in FIGS. 12 and 13, the heat exchanger 51 provides for the transfer of heat between three fluids, such as for the use of both engine and transmission oil to heat water for use in cab heating the trucks propelled by diesel engines. Thus, arrow D indicates the flow of water into the heat exchanger through opening 68 in plate 67, openings 59 in the elements 52 and opening 76 in the baffle 53; flow being stopped by the lower closure plate 72. Flow is directed through the parallel flow passages 66 formed between the elements 52 to the opposite end of the heat exchanger and then passes downward through openings 60, opening 77 in baffle 53 and opening 73 in plate 72 as shown by arrow E.

Transmission oil enters the heat exchanger as shown by arrow F through opening 69 and openings 62 in the elements to the baffle. Then the oil flows through the passages 65 in the set 54 countercurrent to the water flow and passes upwards through openings 63 in the elements 52 and opening 71 in plate 67 to exit as indicated by arrow G. Likewise, engine oil enters opening 74 and openings 62 in the set 55 of elements 52 as indicated by arrow H until stopped by the baffle 53. This oil then passes through passages 65 in the set 55 and passes downwards through openings 63 in the elements 52 and opening 75 in plate 72 to exit as shown by arrow J.

Thus, heat from the hot transmission and engine oils can be transferred to the water.

Figure 14:
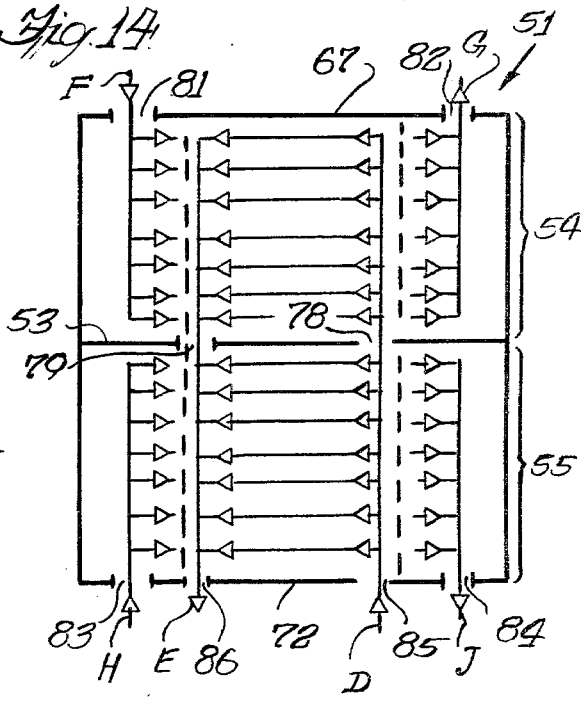
FIG. 14 is a schematic flow diagram of an alternate flow pattern for the heat exchanger of FIG. 12.

Alternatively, the inner flow path could be used for the single fluid and the outer path for the other two fluids as shown in FIG. 14. In this figure, the openings in the baffle 53 and the upper and lower closure plates 67 and 72 are rearranged. The baffle 53 now has a pair of smaller openings 78 and 79 aligned with the openings 62 and 63 instead of the large openings 76 and 77. Also, the upper closure plate 67 has a pair of large openings 81 and 82 aligned with openings 59 and 60 in element set 54 and no smaller openings, while lower closure plate 72 has a pair of large openings 83 and 84 and a pair of smaller openings 85 and 86.

Considering the flow pattern of this embodiment, the single fluid, such as water, enters opening 85 in plate 72 as shown by arrow D and passes upwardly through openings 62 in both sets 55 and 54 and opening 78 in baffle 53. Then the fluid passes through passages 65 in the elements 52 and down through openings 63, opening 79 in baffle 53 and opening 86 in plate 72 as shown by arrow E. The second fluid as shown by arrow F enters opening 81 and openings 59 in set 54 to pass through passages 66 above the baffle 53 countercurrent to the flow of the first fluid. This fluid exits upwards through openings 60 and opening 82 as shown by arrow G.

The third fluid enters the lower set 55 of elements, as shown by arrow H via the opening 83 in the plate 72 and the openings 59 to flow through the lower set of passages 66 below the baffle 53. This fluid then passes downward through openings 60 in the low element set 55 and opening 84 in the plate 72 as indicated by the arrow J.

Figure 15:
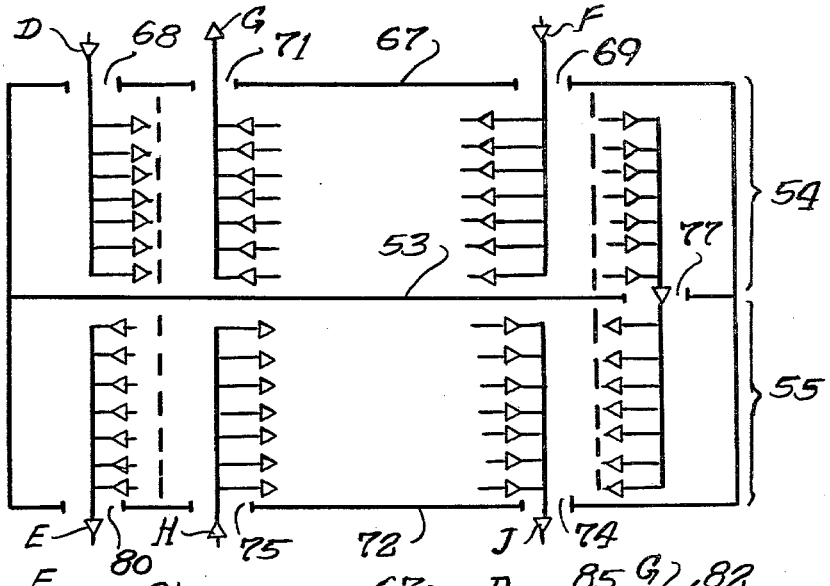
FIG. 15 is a schematic flow diagram similar to FIG. 13, but providing a series flow arrangement.

FIG. 15 shows a flow pattern similar to that of FIG. 13, except the primary fluid passes in series through the two separate oil flows. The baffle 53 has only one large opening 77 at the end opposite to the inlet opening 68 in the upper closure plate 67, and the lower closure plate 72 has a large opening 80 shifted to the end in general alignment with opening 68. Thus, the flow of the primary fluid (water) enters opening 68 (arrow D) and passes down through the openings 59 in upper elements 52 until blocked by the baffle plate 53 and passes longitudinally through the upper set of elements 52. At the opposite end, the fluid passes downward through openings 60 and opening 77 in the baffle to enter the lower set of elements and longitudinally through the elements in the opposite direction to the flow in the first set of elements to the end containing openings 59. The fluid then passes downward to exit from opening 80 in plate 72.

Transmission oil enters at arrow F and exits at arrow G in the same flow pattern as shown in FIG. 13. However, if the engine oil is to flow countercurrent to the water flow in the lower set of elements 52, it must enter the opening 75 and exit through the opening 74 in the lower closure plate 72. Obviously, the engine oil could flow in the same pattern as FIG. 13 concurrent with the flow of water, but the heat transfer would be less efficient.

Figure 16:
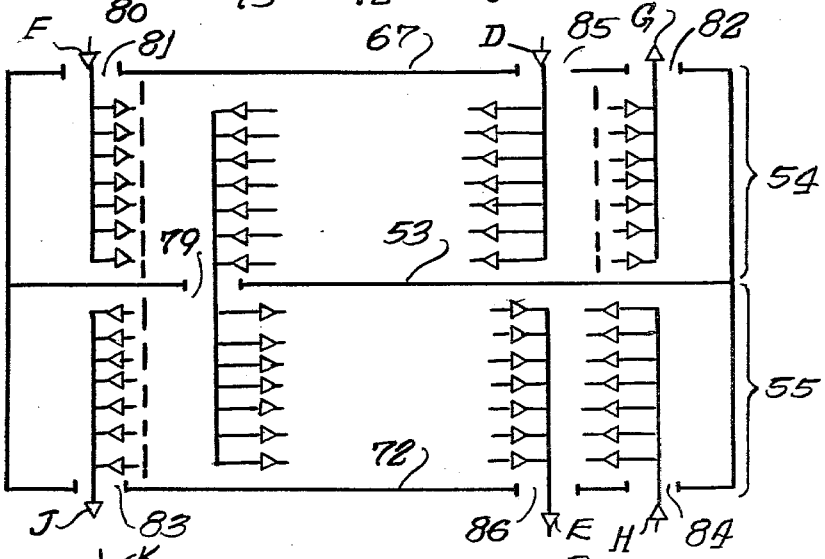
FIG. 16 is a schematic flow diagram similar to FIG. 14, but showing a series flow arrangement.
Figure 18:
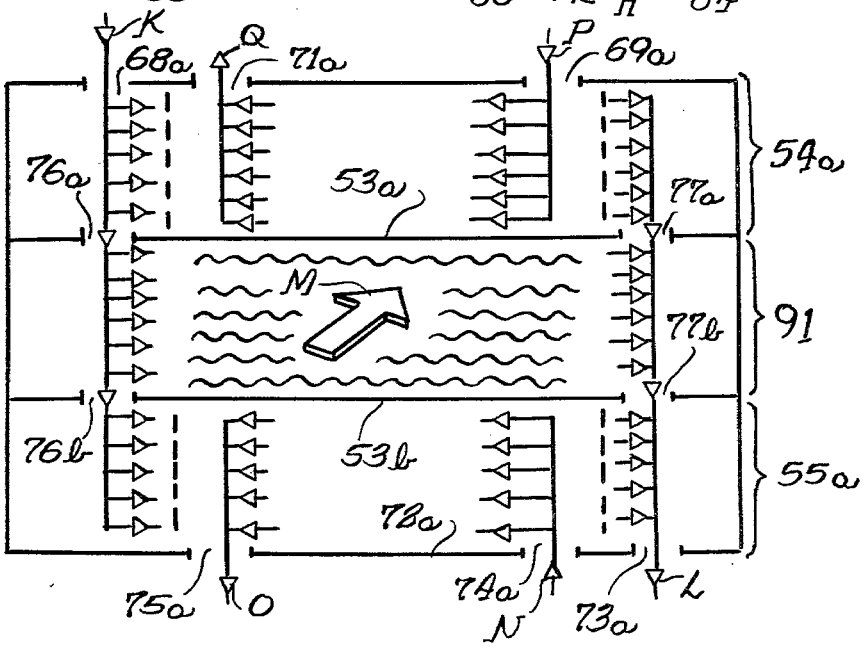
FIG. 18 is a schematic flow diagram of the flow pattern for the heat exchanger of FIG. 17.

In FIG. 16, a flow pattern similar to FIG. 14 is shown, except the primary fluid flows in a series pattern. Thus, water enters opening 85 (arrow D) and flows through the small openings 62 to the baffle 53, across the upper element set 54, down through opening 79 in baffle 53 and through openings 63 in the lower set 55, across the lower set and downward through openings 62 below the baffle to exit out opening 86 (arrow E). In this version, the opening 85 was moved from the lower plate 72 to the upper plate 67.

A first oil flow enters the upper set 54 through the opening 81 (arrow F) and the openings 59, through the passages 66 in the upper set, and up through openings 59 to exit through opening 82 (arrow G). A second oil flow enters the lower set 55 through opening 84 (arrow H) and openings 60, passes through passages 66 in the lower set, and down through openings 59 to exit through opening 83 (arrow J).

FIGS. 17 through 20 illustrate a third embodiment of heat exchanger 90 which incorporates the entirety of the heat exchanger 51 of FIG. 12 therein, but with the upper and lower sets 54 and 55 of elements 52 separated by a third or intermediate set of elements 91; and parts identical to those of FIG. 12 will have the same reference numeral with the addition of a script a. The heat exchanger 90 is capable of handling four fluids in the three sets of elements **54*a*, 91 and 55*a* all stacked together in vertical alignment with an upper closure plate 67*a* having a large opening 68*a* adjacent one end, an upper baffle 53*a*, a lower baffle 53*b*, and a lower closure plate 72*a*. The intermediate set 91 consists of elongated horizontal elements 92, each element formed of a generally flat plate 93, each plate having a depending peripheral flange 94 and raised flanges 95 at each end defining large openings 96 and 97. A fluid passage 98 is formed between two joined facing plates 93,93 which may be divided into a pair of parallel paths in the same manner as shown in FIGS. 3 and 4**.

The joined plates 93,93 forming an element 92 have oppositely extending flanges 95 at each end to be joined to the flanges of the next adjacent plate; the upper baffle **53*a* joined to the uppermost element 92 with the openings 76*a* and 77*a* aligned with the openings 96 and 97. Likewise, the lower baffle 53*b* is joined to the lowermost element 92 and has openings 76*b* and 77*b* aligned with openings 96 and 97. Spaces 99 formed between the elements 92 have corrugated fins 101 therein acting to enhance the transfer of heat from the fluid passing through the passages 98** to the fluid (air) passing transversely between the elements.

The upper closure plate **67*a* is provided with a large opening 68*a* in alignment with the opening 96 of elements 92 and has smaller openings 69*a* and 71*a* aligned with openings 62*a* and 63*a* of the upper set 54*a*. If desired, an overflow fitting and pressure cap (as seen in FIGS. 1 and 2) can be inserted in the plate 67*a* generally aligned with the openings 60*a*. The lower closure plate 72*a* has a large opening 73*a* aligned with the openings 60*a* and small openings 74*a* and 75*a* aligned with openings 62*a* and 63*a*, respectively, in the lower set 55*a* of elements 52*a***.

Considering the flow pattern of the heat exchanger 90, a first fluid (water or coolant) enters the heat exchanger as indicated by arrow K through opening **68*a* in plate 67*a* and passes downward through aligned openings 59*a* in element set 54*a*, opening 76*a* in upper baffle 53*a*, openings 96 in elements 92, opening 76*b* in lower baffle 53*b*, and openings 59*a* in element set 55*a* until stopped by plate 72*a*. This fluid then flows through the parallel passages 66*a* and 98 across the heat exchanger and then passes downward through openings 60*a*, opening 77*a* in baffle 53*a*, openings 97, opening 77*b* in baffle 53*b*, and openings 60*a* in set 55*a* to exit through opening 73*a* in plate 72*a* as indicated by arrow L. The fluid passing through passages 98** is cooled by air flow (a second fluid denoted by arrow M) through the spaces 99 and around fins 101. A third fluid, such as engine oil, enters the heat exchanger 90 through opening 74*a* in plate 72*a*, as indicated by arrow N, and passes up through openings 62*a* in element set 55*a* and then through the passages 65*a* below the lower baffle 53*b*; flow of the third fluid being countercurrent to the first fluid flow. This third fluid passes down through openings 63*a* and exits by opening 75*a* as shown by arrow O. The fourth fluid, such as transmission oil, enters through opening 69*a* in upper closure plate 67*a* (arrow P) and passes down through openings 62*a* in element set 54*a* and through the passages 65*a* above the upper baffle 53*a*. This fluid, having passed countercurrent to the first fluid, moves upward through openings 63*a* to exit through opening 71*a* (arrow Q).

Figure 17:
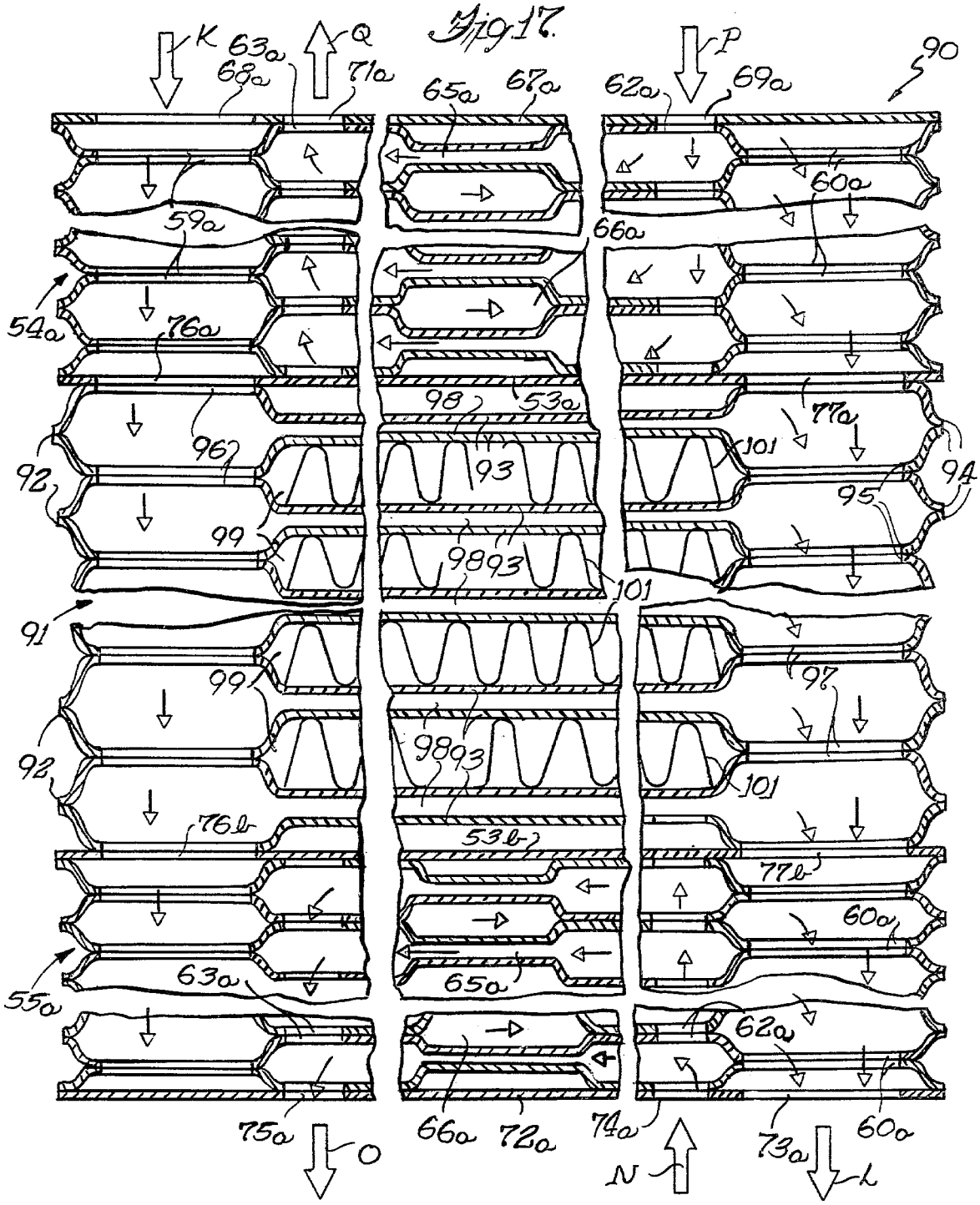
FIG. 17 is a vertical cross section with portions broken away of a third embodiment of heat exchanger for four fluids.
Figure 19:
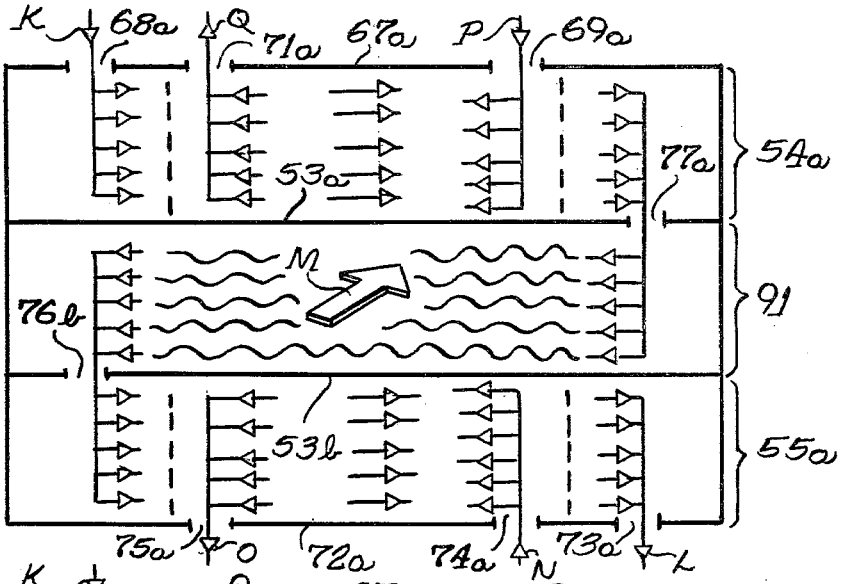
FIG. 19 is a schematic flow diagram similar to FIG. 18, but showing a series flow arrangement.
Figure 20:
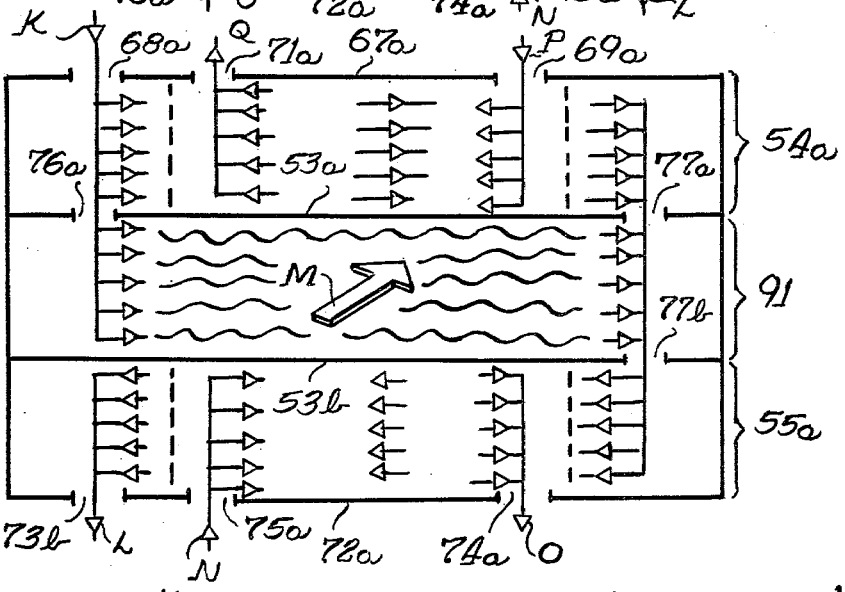
FIG. 20 is a schematic flow diagram similar to FIG. 18, but showing a third flow sequence.

FIGS. 19 and 20 disclose two alternate flow patterns for heat exchanger of FIG. 17 wherein a type of series flow pattern is utilized for the primary fluid. In FIG. 19 each closure plate has the same arrangement of openings as FIGS. 17 and 18, while each baffle has only one opening for the series flow. Water enters the heat exchanger through opening 68*a* (arrow K) and down through openings 59*a* in the first set 54*a* to the upper baffle 53*a*, through the passages 66*a* to the opposite end. This fluid moves downward through openings 60*a*, opening 77*a* in baffle 53*a* and openings 97 in the intermediate set 91 to lower baffle 53*b*, across the plates 92 to openings 96, down through openings 96, opening 76*b* in baffle 53*b* and openings 59*a* in the lower set 55*a* to lower plate 72*a*, across the set 55*a* and down through openings 60*a* to exit through opening 73*a* (arrow L). A second fluid (air) passes between the elements 92 of the intermediate set 91 (arrow M) to cool the liquid in the passages 98.

A first oil to be cooled enters the lower set 55*a* through opening 74*a* (arrow N) and openings 62*a* to the baffle 53*b*, moves through passages 65*a* to the opposite end countercurrent to the water flow, and down through openings 63*a* to exit through opening 75*a* (arrow O). A second oil to be cooled enters the upper set 54*a* through opening 69*a* (arrow P) and openings 62*a* to the baffle 53*a*, across the set 54*a* and up through openings 63*a* to exit through opening 71*a* (arrow Q). Thus, the water initially cools the oil flowing in the upper set 54*a*, then is cooled by the air flow in the intermediate set 91 and then cools the oil flowing in the lower set 55*a*.

In FIG. 20, the upper closure plate 67*a* and upper baffle 53*a* has the same configuration of openings as in FIG. 17, the lower baffle 53*b* has only the one opening 77*b*, and the lower closure plate 72*a* has three openings but opening 73*b* has been shifted from the right-hand end to the left-hand end of the heat exchanger. In this version, water entering opening 68*a* (arrow K) passes downward through openings 59*a*, opening 76*a* in baffle 53*a* and openings 96 in set 91 and passes across the plates of both the upper set 54*a* and the intermediate set 91. This water then passes downward through openings 60*a* of upper set 54*a*, opening 77*a*, openings 97, opening 77*b* and openings 60*a* of lower set 55*a*, passes across through the set 55*a* and downward through openings 59*a* of lower set 55*a* to exit through opening 73*b* (arrow L).

The flow of air (arrow M), the first oil (arrows N and O) and the second oil (arrows P and Q) is the same as shown in FIG. 19, except the first oil flow enters opening 75*a* and exits from opening 74*a* to be countercurrent to the flow of water in the lower set 55*a*. Thus, the water passing through the upper set 54*a* cools the oil passing through that set while the parallel water flow through the set 91 is simultaneously cooled by air. Upon recombining, the water then cools the oil passing through the lower set 55*a*.

Figure 21:
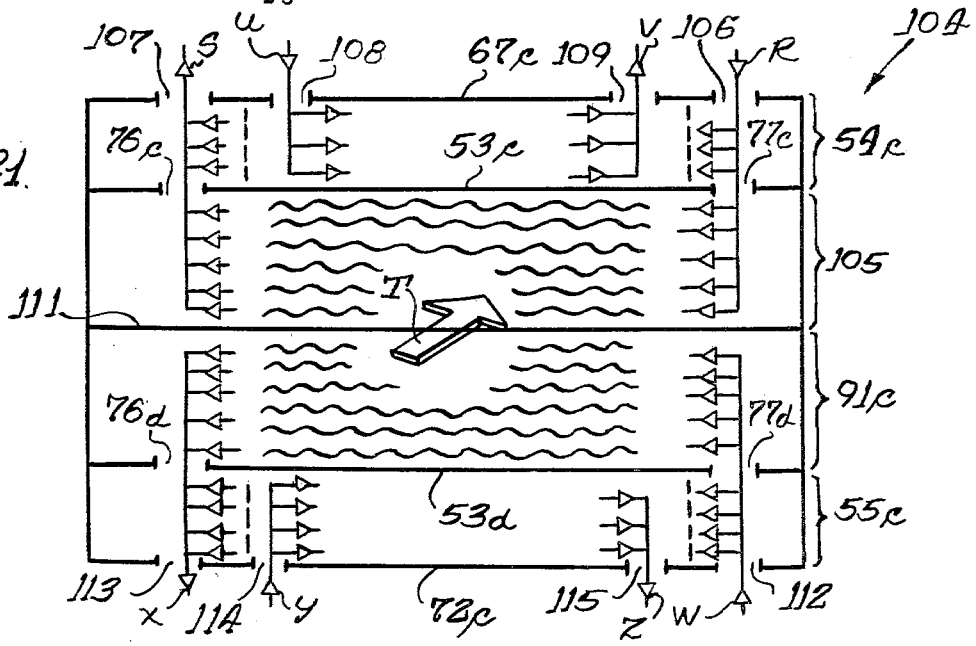
FIG. 21 is a schematic flow diagram for a fourth embodiment of heat exchanger for five fluids.

FIG. 21 schematically discloses a fourth embodiment of heat exchanger 104 which is similar to the heat exchanger 90 except for the insertion of a second air-to-liquid cooler 105, such as an evaporator coil, between the upper set 54*c* of plates and the intermediate set 91*c* of air-to-liquid plates. An upper closure plate 67*c* has a pair of large openings 106 and 107 and a pair of smaller openings 108 and 109, the upper baffle 53*c* has a pair of large openings 76*c* and 77*c*, an intermediate baffle 111 is imperforate, a lower baffle 53*d* has large openings 76*d* and 77*d*, and the lower closure plate 72*c* has a pair of large openings 112 and 113 and a pair of smaller openings 114 and 115.

The upper sets 54*c* and 105 of elements are substantially identical to the lower sets 91*c* and 55*c*, but reversed. Thus, the coolant, such as a refrigerant, enters the opening 106 in plate 67*c* (arrow R) passes through the openings in the upper set 54*c*, opening 77*c* and the openings in the element set 105 to pass through parallel passages in the sets 54*c* and 105, and exits through openings in set 105, opening 76*c* in baffle 53*c*, openings in the upper set 54*c* and opening 107 (arrow S). Air (arrow T) passes between the passages of the element set 105 to be cooled. Also, transmission or engine oil enters the upper set through opening 108 (arrow U) moves through the passages in upper set 54*c* and exits through opening 109 (arrow V). The central baffle 111 completely separates the upper set 54*c* of elements and air-to-liquid set 105 from the element set 91*c* and the lower set 55*c* of elements.

Water or other suitable engine coolant enters the heat exchanger 104 through the opening 112 (arrow W) and passes upward through the large openings in the sets 55*c* and 91*c* and opening 77*d* in baffle 53*d*, and then passes in parallel through the elements of the two sets; air (arrow T) passing across the passages in the set 91*c*. The water then passes down through the openings in the sets and opening 76*d* and exits through opening 113 (arrow X). Oil enters through opening 114 (arrow Y) in plate 72*c*, passes countercurrent to water flow through passages in the lower set 55*c* and downward to exit through opening 115 (arrow Z).

This system utilizes five fluids and provides the capability of either heating or cooling tthe air passing through the heat exchanger (arrow T) to either heat or cool the cab or interior of a vehicle. Normally, the coolant will be constantly flowing to cool the vehicle engine, but the refrigerant will not flow unless cooling of the air is desired. If cool air is desired, the heated air from the element set 91*c* will be diverted so as not to enter the interior of the vehicle.

Although the present invention is shown and described as particularly suited to a radiator for cooling of coolant for a vehicle engine by the flow of air as a third fluid and cooling of the transmission and/or engine oil, this heat exchanger could be utilized for other suitable multiple fluid systems, and it is not my desire or intent to unnecessarily limit the scope or utility of the improved features by virtue of this illustrative embodiment.

I claim:

1. A multiple fluid heat exchanger comprising a plurality of longitudinally extending first fluid conducting elements disposed in a stacked relation, a plurality of longitudinally extending second fluid conducting elements disposed in stacked relation with said first fluid elements, said first set of fluid elements including pairs of dished plates joined at their edges and having enlarged openings at each end forming a fluid inlet at one end and a fluid outlet at the opposite end, a first fluid passage in each first element extending between said pairs of openings, second fluid passages formed between said first fluid passages of said first set of elements, said second set of fluid elements including pairs of flat plates joined together with outwardly diverging peripheral edges joined to the peripheral edges of the next adjacent joined pairs of plates and having enlarged openings at each end forming a fluid inlet at one end and a fluid outlet at the opposite end, fluid passages formed between said pairs of joined plates bounded by the joined peripheral edges and extending between said enlarged openings, oppositely raised ribs in each joined pair of plates forming a third fluid passage therein located between said last mentioned fluid passages, raised flanges at each end of said raised ribs defining axially aligned second openings for entrance and exit of said third fluid, said raised flanges of the pairs of joined plates abutting and joined to the raised flanges of the next adjacent pairs of plates, said second openings in said second elements spaced from and located between said enlarged openings in said elements and communicating with said third fluid passages extending therebetween, said enlarged fluid inlets and outlets in said first and second fluid elements being in registry to form at least one fluid inlet chamber and at least one fluid outlet chamber.

2. A multiple fluid heat exchanger as set forth in claim 1, in which said enlarged openings in said first elements are defined by oppositely raised flanges abutting the raised flanges of the next adjacent elements to provide spaces between said first elements, said first mentioned fluid passages receiving a first fluid passing therethrough, said second fluid passages being formed by said spaces between said first set of elements for a second fluid to pass therethrough transversely to the first passages, and a third fluid passes through the third fluid passages in said second set of elements.

3. A multiple fluid heat exchanger as set forth in claim 1, in which the direction of flow of the third fluid in said second elements is countercurrent to the flow of the first fluid in said second elements.

4. A multiple fluid heat exchanger as set forth in claim 1, in which said plates forming said first and second elements are stacked and simultaneously bonded together.

5. A multiple fluid heat exchanger as set forth in claim 1, in which said first fluid enters all of the first fluid passages in said first and second elements substantially simultaneously to flow in the same direction to the fluid outlet.

6. A multiple fluid heat exchanger as set forth in claim 1, in which a plate is inserted between said first elements and said second elements to block flow of said first fluid from said inlet chamber of the first elements directly to said second elements, said plate having an opening aligned with said fluid outlet chamber allowing flow from said outlet chamber in the first elements to said second elements, the fluid outlet from the second elements being aligned with the fluid inlet for said first elements.

7. A multiple fluid heat exchanger as set forth in claim 6, in which the flow direction of said first fluid in said second elements is opposite to the direction of first fluid flow in said first elements.

8. A multiple fluid heat exchanger as set forth in claim 1, including a single downwardly dished plate identical with said first mentioned dished plates at the lower end of the stack of first elements to engage and cooperate with the uppermost plate of the stack of second elements.

9. A multiple fluid heat exchanger as set forth in claim 8, in which said single plate has a downwardly and outwardly extending periphery, and the uppermost plate of said second elements has an upwardly and outwardly extending periphery secured to the periphery of said single plate, said single plate and said uppermost plate of said second elements forming a passage for said first fluid.

10. A multiple fluid heat exchanger as set forth in claim 1, in which the distance between the first fluid openings in said second elements is greater than the distance between the second openings.

11. A multiple fluid heat exchanger as set forth in claim 10, in which said first fluid openings in the second elements are in fluid communication with the fluid inlet chamber and the fluid outlet chamber of said first elements, and a plate at the lower end of the stack of second elements having an opening aligned with said fluid outlet chamber and communicating with an outlet conduit, and openings aligned with said second openings.

12. A multiple fluid heat exchanger as set forth in claim 11, in which said plate closes the lower end of said fluid inlet chamber.

13. A multiple fluid heat exchanger as set forth in claim 10, including a first plate at the lower end of the stack of second elements and having an opening generally aligned with said first fluid openings in the second elements and said inlet chamber, and openings aligned with said second openings, said plate closing off said openings in said second elements communicating with said fluid outlet chamber, and a second plate located between said first elements and said second elements having an opening communicating with said fluid outlet chamber, said second plate closing the lower end of said fluid inlet chamber of said first elements.

14. A multiple fluid heat exchanger as set forth in claim 1, including a flat plate engaging and joined to the periphery and the raised flanges of the lowest plate of the lowermost second element to form a first fluid passage therebetween, said plate having an opening aligned with one of the first fluid openings in the second elements to provide an outlet for the first fluid.

15. A multiple fluid heat exchanger as set forth in claim 14, in which said plate has a pair of openings aligned with the second openings defined by said raised flanges on the second elements for the entrance and exit of the third fluid.

16. A multiple fluid heat exchanger as set forth in claim 15, in which said fluid inlet chamber in said first elements communicates with the aligned openings in the second elements and said plate closes off the last mentioned openings and inlet chamber, and said fluid outlet chamber in said first elements communicates with the aligned openings in the second elements and the opening in said plate.

17. A multiple fluid heat exchanger as set forth in claim 15, including a second flat plate located between said first and second elements, said second plate closing off the lower end of the fluid inlet chamber and having an opening aligned and allowing communication with said first fluid outlet chamber and the aligned openings in the second element, said first mentioned plate having its opening aligned with the openings in the second elements laterally removed from said fluid outlet chamber.

18. A multiple fluid heat exchanger as set forth in claim 1, in which said first and second sets of elements are formed of identical pairs of generally flat plates joined together over a portion thereof and having outwardly diverging peripheries joined to the peripheries of the next adjacent element, said smaller openings being defined by flanges raised to the height of said periphery and said fluid passage between a pair of smaller openings being formed by oppositely raised ribs formed in said pair of flat plates, said joined peripheries of adjacent elements forming a fluid passage therebetween, and a baffle plate between a pair of adjacent elements having at least one opening therein for passage of a fluid therethrough between said sets of elements.

19. A multiple fluid heat exchanger as set forth in claim 18, in which an upper closure plate having at least a pair of openings therein is joined to the upper element of said first set of elements, and a lower closure plate having at least a pair of openings therein is joined to the lowest element of said second set of elements.

20. A multiple fluid heat exchanger as set forth in claim 19, in which said upper and lower closure plates each has a pair of openings aligned with said smaller openings in elements.

21. A multiple fluid heat exchanger as set forth in claim 19, in which said baffle plate has a pair of enlarged openings therein aligned with the enlarged openings in said sets of elements, said upper closure plate has an enlarged opening adjacent one end aligned with the enlarged openings at one end of said sets of elements, and said lower closure plate has an enlarged opening aligned with the enlarged openings at the opposite ends of said sets of elements.

22. A multiple fluid heat exchanger as set forth in claim 21, wherein a first fluid enters the enlarged opening in said upper closure plate, passes through the fluid passages formed between the elements of both sets and exits through the enlarged opening in said lower closure plate, a second fluid enters through one smaller opening and exits through the other smaller opening in said upper closure plate and passes countercurrent to said first fluid in passages formed in the first set of elements, and a third fluid enters one smaller opening and exits through the other smaller opening in said lower closure plate and passes countercurrent to said first fluid in passages formed in said second set of elements.

23. A multiple fluid heat exchanger as set forth in claim 19, in which said upper closure plate has a pair of enlarged openings therein aligned with the enlarged openings in said first set of elements, said baffle plate has a pair of smaller openings aligned with the smaller openings in both sets of elements, and said lower closure plate has a pair of enlarged openings and a pair of smaller openings aligned with the enlarged openings and smaller openings, respectively, in said second set of elements.

24. A multiple fluid heat exchanger as set forth in claim 23, wherein a first fluid enters and exits through the opposite enlarged openings in the upper closure plate and passes through the fluid passages formed between said first set of elements, a second fluid enters and exits through the opposite enlarged openings in the lower closure plate and passes through the fluid passages formed between said second set of elements, and a third fluid enters and exits through the smaller openings in the lower closure plate and passes through the smaller openings in said baffle plate and through the passages formed in both sets of elements countercurrent to the flow of the first and second fluids.

25. A multiple fluid heat exchanger as set forth in claim 18, including a third set of heat exchanger elements disposed in stacked relation between and aligned with said first and second sets of elements, said third sets of elements having elongated fluid passages vertically spaced apart with enlarged end portions joined together and having enlarged openings therein aligned with the enlarged openings in the first and second sets of elements, said baffle plate forming an upper baffle between said first and third sets of elements, and a lower baffle between said third and second sets of elements.

26. A multiple fluid heat exchanger as set forth in claim 25, wherein corrugated fins are located in the spaces between said third set of elements, said first fluid passing through the fluid passages of said third set of elements, and a fourth fluid passing between the elements of said third set transverse to the flow directions of said other fluids.

27. A multiple fluid heat exchanger as set forth in claim 26, in which said upper and lower baffle plates each have at least one opening aligned with the enlarged openings in the sets of elements.

28. A multiple fluid heat exchanger as set forth in claim 27, in which said upper baffle has an opening adjacent the end opposite to said first fluid inlet in said upper closure plate, and said lower baffle has an opening adjacent the end opposite to the opening in the upper baffle.

29. A multiple fluid heat exchanger as set forth in claim 27, in which said upper baffle has a pair of openings and said lower baffle has an opening adjacent the end opposite to the first fluid inlet in the upper closure plate, and the lower closure plate has an opening generally aligned with said first fluid inlet to act as a first fluid outlet.

30. A multiple fluid heat exchanger as set forth in claim 27, in which said upper baffle and lower baffle have a pair of openings, the openings in each baffle being axially aligned.

31. A multiple fluid heat exchanger as set forth in claim 25, in which a fourth set of heat exchange elements are disposed in stacked relation between and aligned with said upper set of elements and said third set of elements, said fourth set of elements being vertically spaced, and an imperforate central baffle between said two sets of air-to-liquid elements.

32. A multiple fluid heat exchanger as set forth in claim 31, in which each coolant fluid is separately cooled by air flow through said air-to-liquid sets of elements, and each oil flow is cooled by its associated coolant.

33. A multiple fluid heat exchanger as set forth in claim 32, in which said upper and lower baffles each have a pair of openings aligned with the large openings in said sets of plates, and said upper and lower closure plates each having a pair of large openings and a pair of smaller openings therein.

34. A multiple fluid heat exchanger as set forth in claim 33, in which one of said third or fourth sets of elements is an evaporator coil for an air conditioner assembly.

35. A two fluid heat exchanger enclosure comprising a plurality of generally flat plates having pairs of plates joined together with outwardly diverging peripheral edges joined to the edges of the next adjacent joined pairs of plates, each plate having openings at each end forming a fluid inlet and a fluid outlet, first fluid passages formed between said pairs of joined plates bounded by the joined peripheral edges and extending between said openings for a first fluid, oppositely raised ribs formed in each joined pair of plates to define a second fluid passage therein located between said first fluid passages, raised flanges at each end of said raised ribs defining axially aligned second openings spaced from and located between said first mentioned openings and communicating with said second passage for a fluid inlet and a fluid outlet of a second fluid, said raised flanges of adjoining pairs of joined plates abutting and joined to the raised flanges of the next adjacent pairs of plates, and a closure plate at each end abutting the peripheral edge of the end plate, one closure plate having an opening aligned with the fluid inlet opening for one of the fluids and the other closure plate having an opening aligned with the fluid outlet openings for said one fluid, and one of said closure plates having spaced openings aligned with said second openings for said other fluid.

36. A two fluid heat exchanger as set forth in claim 35, in which the direction of flow in said second fluid passages is countercurrent to the direction of flow in said first fluid passages.

37. A two fluid heat exchanger as set forth in claim 35, in which said second openings are spaced from and located between said first mentioned openings.

38. A two fluid heat exchanger as set forth in claim 35, in which one of said plates has at least one enlarged opening generally aligned with said first fluid inlet or outlet.

* * * * *